US007465878B2

(12) United States Patent
Dollins et al.

(10) Patent No.: US 7,465,878 B2
(45) **Date of Patent: *Dec. 16, 2008**

(54) INDICIA-MARKED ELECTRICAL CABLE

(75) Inventors: James C. Dollins, Bristol, RI (US); Anthony J. Mauro, Assonet, MA (US)

(73) Assignee: WPFY, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/920,278

(22) Filed: Aug. 18, 2004

(65) Prior Publication Data

US 2005/0016754 A1 Jan. 27, 2005

Related U.S. Application Data

(63) Continuation of application No. 09/573,490, filed on May 16, 2000, now Pat. No. 6,825,418.

(51) Int. Cl.
*H01B 7/36* (2006.01)

(52) U.S. Cl. ..... 174/112

(58) Field of Classification Search ..... 174/102 R, 174/102 D, 112, 113 R
See application file for complete search history.

(56) References Cited

U.S. PATENT DOCUMENTS

| | | | |
|---|---|---|---|
| 242,813 | A | 6/1881 | Chinnock |
| 277,248 | A | 5/1883 | Edgerton |
| 403,262 | A | 5/1889 | Garland |
| 769,366 | A | 9/1904 | Waterman |
| 817,057 | A | 4/1906 | Greenfield |
| 840,766 | A | 1/1907 | Greenfield |
| 951,147 | A | 3/1910 | Porter dec'd |
| 1,068,553 | A | 7/1913 | Abell et al. |
| 1,383,187 | A | 6/1921 | Brinkman et al. |
| 1,580,760 | A | 4/1926 | Palmer |
| 1,596,215 | A | 8/1926 | Palmer |
| 1,617,583 | A | 2/1927 | Fentress |
| 1,781,574 | A | 11/1930 | Frederickson |
| 1,913,390 | A | 6/1933 | Hungerford |
| 1,976,804 | A | 10/1934 | Ringel |
| 1,995,407 | A | 3/1935 | Walker |
| 2,070,679 | A | 2/1937 | Pebuck et al. |
| 2,086,152 | A | 7/1937 | Bedell |
| 2,106,048 | A | 1/1938 | Candy, Jr. |
| 2,118,630 | A | 5/1938 | Waldron |
| 2,125,869 | A | 8/1938 | Atkinson |
| 2,234,675 | A | 3/1941 | Johnson |
| 2,316,293 | A | 4/1943 | Scott |

(Continued)

FOREIGN PATENT DOCUMENTS

| | | |
|---|---|---|
| CH | 449732 | 4/1968 |

(Continued)

OTHER PUBLICATIONS

Prior Art Cable, 1 page.

(Continued)

*Primary Examiner*—Chau N Nguyen
(74) *Attorney, Agent, or Firm*—Fish & Richardson P.C.

(57) ABSTRACT

An electrical cable includes a sheath that envelops at least two internal conductors, and an indicia visible on the sheath is representative of the internal conductor.

11 Claims, 2 Drawing Sheets

U.S. PATENT DOCUMENTS 2,372,868 A 4/1945 Warren, Jr.
2,379,318 A 6/1945 Safford
2,414,923 A 1/1947 Batcheller
2,446,387 A 8/1948 Peterson
2,464,124 A 3/1949 Duvall
2,504,178 A 4/1950 Burnham et al.
2,516,751 A 7/1950 Brown
2,591,794 A 4/1952 Ebel
2,628,998 A 2/1953 Frisbie
2,663,754 A 12/1953 Bianco
2,688,652 A 9/1954 Schumacher
2,816,200 A 12/1957 Mudge
2,944,337 A 7/1960 Coleman
3,020,335 A 2/1962 Gillis
3,073,944 A 1/1963 Yuter
3,197,554 A 7/1965 Baker
3,229,623 A * 1/1966 Rubinstein et al. ..... 101/32
3,287,490 A 11/1966 Wright
3,311,133 A 3/1967 Kinander
3,328,514 A 6/1967 Cogelia
3,383,456 A 5/1968 Kosak
3,459,233 A 8/1969 Webbe
3,459,878 A 8/1969 Gressitt et al.
3,474,559 A 10/1969 Hunt
3,551,542 A 12/1970 Perrone
3,551,586 A 12/1970 Dembiak et al.
3,636,234 A 1/1972 Wakefield
3,650,862 A 3/1972 Burr
3,682,203 A 8/1972 Foti et al.
3,720,747 A 3/1973 Anderson et al.
3,748,372 A 7/1973 McMahon et al.
3,790,697 A 2/1974 Buckingham
3,815,639 A 6/1974 Westerbarkey
3,834,960 A 9/1974 Prentice
3,865,146 A 2/1975 Meserole
3,913,623 A 10/1975 Siegwart
3,938,558 A 2/1976 Anderson
3,994,090 A * 11/1976 Wheeler ..... 40/316
4,021,315 A 5/1977 Yanagida et al.
4,029,006 A 6/1977 Mercer
4,029,129 A 6/1977 Harper
4,128,736 A 12/1978 Nutt et al.
4,139,936 A 2/1979 Abrams et al.
4,141,385 A 2/1979 Siegwart
4,154,976 A 5/1979 Brorein
4,158,746 A 6/1979 Taylor et al.
4,161,564 A 7/1979 Legbandt
4,187,391 A 2/1980 Voser
4,196,464 A 4/1980 Russell
4,197,728 A 4/1980 McGowen
4,274,086 A 6/1981 Benckendorff et al.
4,278,836 A 7/1981 Bingham
4,280,225 A 7/1981 Willis
4,284,842 A 8/1981 Arroyo et al.
4,303,733 A 12/1981 Bulle et al.
4,310,946 A 1/1982 Baker
4,319,940 A 3/1982 Arroyo et al.
4,326,561 A 4/1982 Kutnyak
4,329,561 A 5/1982 Schafer et al.
4,340,773 A 7/1982 Perreault
4,360,704 A 11/1982 Madry
4,376,229 A 3/1983 Maul et al.
4,406,914 A 9/1983 Kincaid
4,423,306 A 12/1983 Fox
4,424,627 A 1/1984 Tarbox
4,441,238 A 4/1984 Hijuelos et al.
4,477,298 A 10/1984 Bohannon et al.
4,499,010 A 2/1985 Tanino et al.
4,528,420 A 7/1985 Kish et al.
4,543,448 A 9/1985 Duerloo
4,547,626 A 10/1985 Pedersen et al.
4,552,989 A 11/1985 Sass
4,579,759 A 4/1986 Breuers
4,595,431 A 6/1986 Bohannon et al.
4,629,285 A 12/1986 Carter et al.
4,644,092 A 2/1987 Gentry
4,701,575 A 10/1987 Gupta et al.
4,719,320 A 1/1988 Strait
4,731,502 A 3/1988 Finamore
4,746,767 A 5/1988 Gruhn
4,749,823 A 6/1988 Ziemek et al.
4,761,519 A 8/1988 Olson et al.
4,778,543 A 10/1988 Pan
H631 H 5/1989 Hamad et al.
4,880,484 A 11/1989 Obermeir et al.
4,947,568 A 8/1990 De Barbieri
4,956,523 A 9/1990 Pawluk
4,965,412 A 10/1990 Lai et al.
4,970,352 A 11/1990 Satoh
4,997,994 A 3/1991 Andrews et al.
5,001,303 A 3/1991 Coleman et al.
5,038,001 A 8/1991 Koegel et al.
5,061,823 A 10/1991 Carroll
5,103,067 A 4/1992 Aldissi
5,171,635 A 12/1992 Randa
5,180,884 A 1/1993 Aldissi
5,189,719 A 2/1993 Coleman et al.
5,216,202 A 6/1993 Yoshida et al.
5,289,767 A 3/1994 Montalto et al.
5,350,885 A 9/1994 Falciglia et al.
5,356,679 A 10/1994 Houis et al.
5,408,049 A 4/1995 Gale et al.
5,470,253 A 11/1995 Siems et al.
5,504,540 A 4/1996 Shatas
5,651,081 A 7/1997 Blew et al.
5,708,235 A 1/1998 Falciglia et al.
5,719,353 A 2/1998 Carlson et al.
5,775,935 A 7/1998 Barna
5,777,271 A 7/1998 Carlson et al.
5,862,774 A 1/1999 Moss
6,017,627 A 1/2000 Iwata et al.
6,825,418 B1 * 11/2004 Dollins et al. ..... 174/112

FOREIGN PATENT DOCUMENTS

DE 328905 6/1919
DE 751575 10/1951
DE 1 902 057 10/1964
DE 35 13 620 10/1985
DE 4016445 8/1991
FR 763504 5/1934
GB 194419 3/1923
GB 332303 7/1930
GB 913514 12/1962
GB 1117862 6/1968
GB 1 432 548 4/1976
GB 2154785 2/1985
JP 55-120031 9/1955
JP 49-20780 6/1972
JP 52-23677 2/1977
JP 52-121679 10/1977
JP 57-143379 4/1982
JP 59-87194 5/1984
JP 60-097179 5/1985
JP 62037186 A2 2/1987
JP 64-81113 3/1989
JP 1-134808 5/1989
JP 3025806 2/1991
JP 03-173015 7/1991
JP 04-312850 4/1992
JP 04-163048 8/1992

NL 65-10231 2/1966

OTHER PUBLICATIONS

Aflex Prior Art Summary, prepared by Bromberg & Sunstein LLP.
Chart: U.S. Patent No. 5,708,235 and Prior Art, prepared by Bromberg & Sunstein LLP.
Answer, Affirmative Defenses and Counterclaim.
First Amended Answer, Affirmative Defenses and Counterclaim.
Joint Statement Pursuant to Local Rule 16.1.
Exhibit A-order entry forms, 1990, 3 pages.
Exhibit B-order entry form, 1990, 2 pages.
Exhibit C-memorandum, 1991, 1 page.
Eastern Wire Publication: "Making Your Cable Even Better," 3 pages.
Alflex Publication: "Alflex Agrees . . . ," 1 page.
AFC Publication: "It Can't be Seen if it isn't Green," 1 page.
Alflex Publication: "Red Alert Fire Alarm & Control Cable," 3 pages.
AFC Publication: "AFC Type AC Flexible Armored Cables," 7 pages.
AFC Publication: "AFC Type MC Flexible Metal Clad Cables," 15 pages.
Eastern Wire Publication: "Fire Alarm Cable for Places of Assembly," 2 pages.
Alflex Publication: "Fire Alarm and Control Cable," 2 pages.
'855 patent claim chart, prepared by Gardere Wynne Sewell LLP (25 pages).
'914 patent claim chart, prepared by Gardere Wynne Sewell LLP (4 pages).
'071 patent claim chart, prepared by Gardere Wynne Sewell LLP (2 pages).
'345 Reissue patent claim chart, prepared by Gardere Wynne Sewell LLP (7 pages).
Partial Translation of 59-87194 prepared by Merrill Translations (2 pages).
Complaint for Patent Infringement, Mar. 31, 2003, *AFC Cable Systems, Inc.* v. *Southwire Company* -03-10591-NG (D. Mass.).
Defendants Response to Plaintiffs' Interrogatories Nos. 109, Feb. 20, 2004, *AFC Cable Systems, Inc.* v. *Southwire Company* -03-10591-NG (D. Mass.).
Defendant's Responses to Plaintiffs' First Set of Requests for Production of Documents and Things (Nos. 1-52), Feb. 20, 2004, *AFC Cable Systems, Inc.* v. *Southwire Company* -03-10591-NG (D. Mass.).
Defendant's Amended Reply to Plaintiffs' Original Complaint with Counterclaim For Declaratory Judgment, Feb. 9, 2004, *AFC Cable Systems, Inc.* v. *Southwire Company* -03-10591-NG (D. Mass.).
Defendant Southwire Company's Initial Disclosures to Plaintiffs Under Rule 26(a)(1), Jan. 15, 2004, *AFC Cable Systems, Inc.* v. *Southwire Company* -03-10591-NG (D. Mass.).
Joint Statement Pursuant to Local Rule 16.1, Jan. 15, 2004, *AFC Cable Systems, Inc.* v. *Southwire Company* -03-10591-NG (D. Mass.).
Defendant Southwire Company's Answer to Plaintiffs' Complaint, Nov. 6, 2003, *AFC Cable Systems, Inc.* v. *Southwire Company* -03-10591-NG (D. Mass.).
Southwire's Amended Reply in Support of Motion to Dismiss or in the Alternative, Transfer for Lack of Personal Jurisdiction and Improper Venue with Exhibits A and B, Sep. 23, 2003, *AFC Cable Systems, Inc.* v. *Southwire Company* -03-10591-NG (D. Mass.).
Southwire's Reply in Support of Motion to Dismiss or in the Alternative, Transfer for Lack of Personal Jurisdiction and Improper Venue, Sep. 16, 2003, *AFC Cable Systems, Inc.* v. *Southwire Company* -03-10591-NG (D. Mass.).
Southwire's Memorandum of Law in Support of Motion to Dismiss or in the Alternative, Transfer for Lack of Personal Jurisdiction and Improper Venue with Exhibits A-C, Aug. 11, 2003, *AFC Cable Systems, Inc.* v. *Southwire Company* -03-10591-NG (D. Mass.).
AFC's Memorandum In Opposition to Alflex's Motion For Leave to Amend and in Support of AFC's Cross-Motion to Strike and Dismiss, Jul. 6, 1998, *AFC Cable Systems, Inc. and WPFY, Inc.* v. *Alflex Corporation*, Civil Action No. 98-10425 MLW (D. Mass.).
AFC Offers New Red! Fire Alarm/Control Cable™, News Release Apr. 22, 1992, 3 pages.
Carlon, "Flex-Plus Blue ENT Electrical Non-Metallic Tubing, Fittings and Accessories," 1987 NEC, Article 331, pp. 1-7.
Columbia Electronic Cables, Publication No. CEC-MC-681, 3 pgs, 1982.
Defendant's Opposition to Plaintiffs' Cross-Motion to Strike Affirmative Defenses and Dismiss Counterclaim, Jul. 30, 1998, *AFC Cable Systems, Inc. and WPFY, Inc.* v. *Alflex Corporation*, Civil Action No. 98-10425-MLW (D. Mass.).
"Introducting America's Fastest Growing City, AFC. We're Wiring America", Aug. 1997, 6 pages.
Keebler, Jim, "Special Wire Industry Study," Wire Technology International, Jan. 1992, pp. 34-39.
Plaintiffs AFC Cable Systems,, Inc.'s and WPFY, Inc.'s Reply Brief in Support of Their Motion to Dismiss Defendant Southwire Company's Declaratory Judgment Counterclaim on U.S. Patent No. 5,557,071, Apr. 6, 2004, *AFC Cable Systems, Inc. and WPFY, Inc.* v. *Southwire Company*, Case No. 03-10591-NG/JGD (D.Mass.).
Plaintiffs' Reply to Alflex's First Counterclaim, Jul. 6, 1998, *AFC Cable Systems, Inc. and WPFY, Inc.* v. *Alflex Corporation*, Civil Action No. 98-CV-10425-MLW (D. Mass.).
Plantiffs'0 Responses and Objections to Defendant's First Set of Interrogatories to Plaintiffs, Aug. 14, 1998, *AFC Cable Systems, Inc. and WPFY, Inc.* v. *Alflex Corporation*, Civil Action No. 98-CV-10425-MLW (D. Mass.).
"Precise Application of Powder Materials to Reel-to-reel Products," ElectroStatic Technology, Inc, 1 page, undated.
"Southwire'Response to Motion to Dismiss," Mar. 19, 2004, *AFC Cable Systems, Inc. and WPFY, Inc.* v. *Southwire Company*, Civil Action No. 03-10591-NG, (D. Mass.).
European Patent Office Communication with Search Report for corresponding European Patent Application No. 01935782 dated Aug. 2, 2005.
"Precise Application of Powder Materials to Reel-to-Reel Products," Electrostatic Technology, Inc., 1 page, undated. It is believed that this reference was publicly available prior to the priority date of the current application.
Jan. 27, 1999 letter from Sullivan & Worcester LLP to Fish & Richardson PC, regarding *AFC Cable Systems, Inc. and WPFY, Inc.* v. *Alflex Corporation*, Civit Action No. 98-CV-10425-MW, 3 pages.
Jul. 1, 2003 letter from Gardere Wynne Sewell LLP to Fish & Richardson PC, 2 pages.
Oct. 27, 2003 letter from Gardere Wynne Sewell LLP to Fish & Richardson PC, regarding *AFC/WPFY* v. *Southwire*, 2 pages.

* cited by examiner

INDICIA-MARKED ELECTRICAL CABLE

This application is a continuation of U.S. application Ser. No. 09/573,490, entitled INDICIA-CODED ELECTRICAL CABLE, filed May 16, 2000 now U.S. Pat. No. 6,825,418.

BACKGROUND

This invention relates to indicia-marked electrical cable.

As shown in FIG. 1, an armored electrical cable 10 used, for example, to wire buildings has insulated wires 12 encased in a helically wound steel sheath 14. To install the cable, the wires at each end of the sheath are stripped of insulation 16, and the exposed conductors 18 are connected to terminals or other wires inside of a junction box, switch box or other enclosure.

The installer knows which connections to make at each end of the cable because the wire insulations are color-coded. For example, a ground wire may have one color, and wires carrying different phases of AC power could have other colors. The insulation colors are often dictated by industry practice. A cable used for a particular purpose, such as to wire three-phase 277-volt power, typically has several (e.g., four) internal wires and a particular combination of color-coded insulations on the wires. The insulation colors may comply, for example, with the B-O-Y (brown, orange, yellow) convention, in which brown, brown and orange, or brown, orange and yellow, are used depending on the number of internal wires that need to be marked in the cable. In addition, common and ground wires in the cable may have gray and green insulations. The installer (or someone who maintains the cable after installation) can easily identify the purpose of a given cable (e.g., that it is a 277-volt cable) by the predefined combination of insulation colors that are associated with that purpose.

As shown in FIG. 2, once the installation is done, the sheath 14 and the junction boxes 20 at both ends of the cable hide the internal wires from view.

The sheath of a cable can be marked to indicate the function of the cable as described in U.S. Pat. No. 5,350,885, incorporated by reference. The markings can include color-coded coatings and patterns.

In general, in one aspect the invention features an electrical cable including a sheath that envelops at least two internal conductors, and an indicia visible on the sheath and representative of the internal conductor.

One of the advantages of the invention is that someone who is familiar with the combination of indicia used on the conductors to imply a particular function for the cable can identify the function by looking only at the sheath.

SUMMARY

Implementations of the invention may include one or more of the following features. Conductor indicia may be visible on the internal conductors. There may be at least two different conductor indicia that are visible on the internal conductors, and at least two different sheath indicia that are visible on the sheath, the sheath indicia being representative of the combination of internal conductors. The sheath indicia may be indicative of the conductor indicia on the conductors. The internal conductors may include electrical wires. The conductor indicia may include the colors of insulation on the conductors. The conductor indicia may be visible at multiple locations along the length of the conductors. The indicia may be visible at multiple locations along the length of the sheath. The sheath indicia may be the same as least one of the conductor indicia. The sheath may include a helically wound metal strip bearing the sheath indicia. The sheath indicia may include a stripe of ink around the circumference of the sheath. The indicia may be representative of a function of the cable. There may be electrical connections between ends of the conductors and terminals or other conductors, junction boxes may contain the electrical connections, and the conductor indicia may be hidden by the sheath and the junction boxes.

In general, in another aspect, the invention features a method of forming a cable by applying a sheath indicia along the length of a surface of a strip of material, wrapping the strip of material to form the sheath, and using the sheath to envelop internal conductors on which conductor indicia are visible, the sheath indicia being representative of the internal conductors.

In general, in another aspect, the invention features an electrical cable including a sheath that envelops an internal conductor, and an indicia visible on the sheath and symbolizing a gauge of the internal conductor.

Other advantages and features will become apparent from the following description and from the claims.

DESCRIPTION

Figure 3:
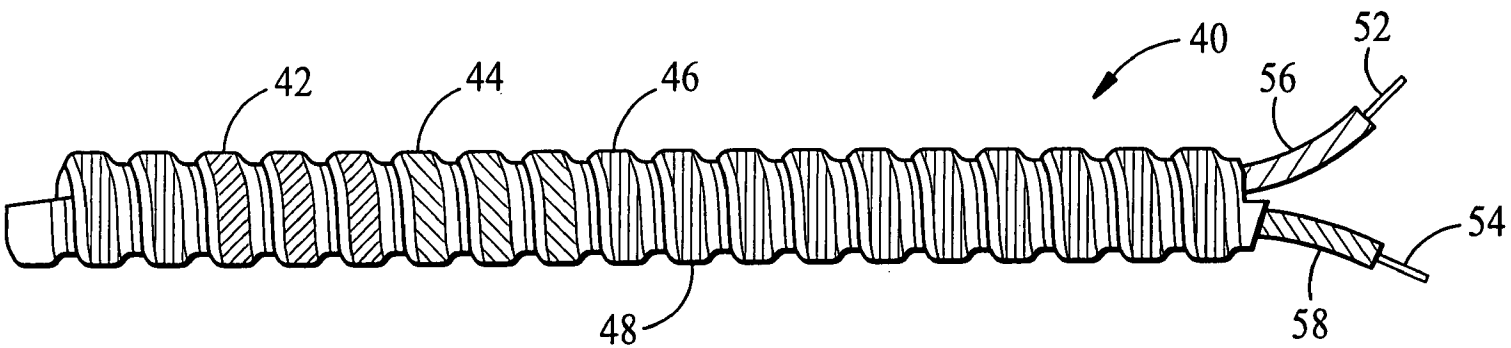
FIG. 3 is a side view of an indicia-coded cable.

In an example implementation of the invention shown in FIG. 3, an MC or AC type 277-volt flexible armored cable 40 includes several internal wires 52, 54 having insulations 56, 58 that are colored, e.g., brown and orange.

As shown in FIG. 3, to indicate that the cable is of the particular type, stripes of color 42, 44, and 46, are marked as stripes around the circumference of the outer surface of the sheath 48. In one example, the colors 42 and 44 are selected to match the colors of the insulations of two of the internal wires. The color 46 is selected to indicate the type of the cable, e.g., MC or AC.

A person who installs or maintains the cable can quickly and intuitively recognize the colors of the stripes 42 and 44 as the ones used for the two insulations in the particular type of cable, even though he may not be able to see the insulation on the internal wires. He can also recognize the cable as being of type MC or AC based on the color of stripe 46. Knowing the type or function of a given cable without seeing the insulations on the internal wires can save time and reduce hazards.

In FIG. 3, the stripes 42, 44, 46 are shown as three different patterns that represent respectively three solid colors: brown and orange, the colors of two of insulations on two of the internal wires, and blue, to indicate that the cable is type MC.

The sequence of three stripes is repeated all along the length of the cable, with each of the two stripes 42, 44 in each set being relatively shorter, for example two inches each, and the stripe 46 being relatively longer, e.g., twenty inches.

Figure 4:
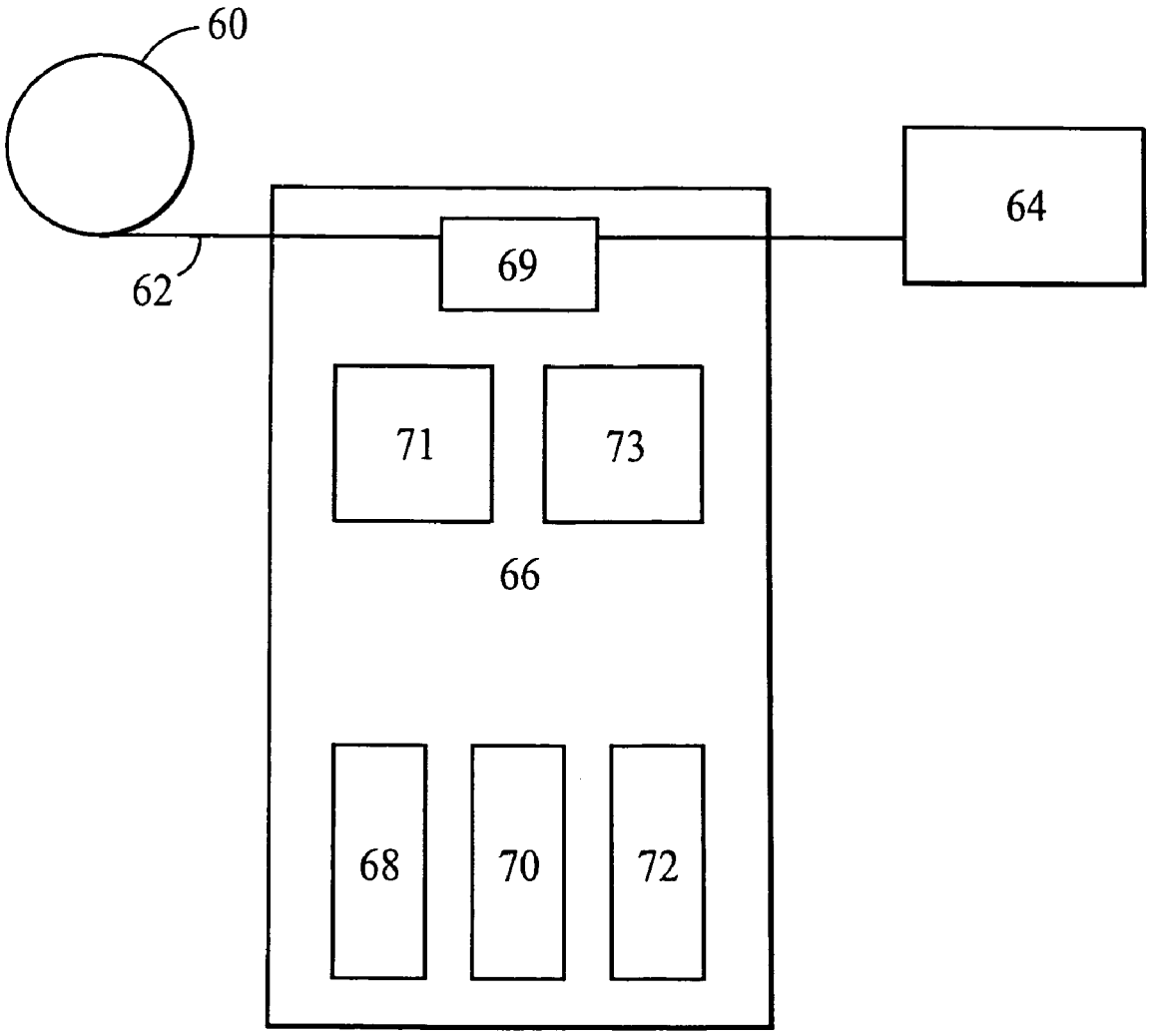
FIG. 4 is a schematic view of a coating machine.

As shown in FIG. 4, one way to mark the sheath of FIG. 3 with the colored stripes is to coat successive sections of a steel strip 62 with colored ink as it comes from a feed roll 60 and just before the strip enters a forming machine 64 where it is convoluted. One good way to apply the ink is by spraying, but the ink could also be applied using wipe, drip, brush, transfer wheel, or transfer roll devices. Multiple coating machines can be provided in sequence along the production line to coat successive ones of the stripes. Or a single coating machine 66 capable of coating different ink colors can apply the colors in succession.

In the case of a single coating machine that applies the ink "on-the-fly" to the steel strip just before it enters the forming (convoluting) machine, the coating machine must be able to switch coating colors quickly and to apply and cure the ink in a short time between when the strip arrives at the coating machine and when it is delivered into the forming machine.

One way to achieve the color switching is to provide reservoirs of liquid ink 68, 70, 72 from which ink can be withdrawn to the coating station 69, and a delivery mechanism 71 that allows rapid switching among the different ink reservoirs 68, 70, 72. The delivery mechanism includes pumping equipment and valving that is controlled by an electronic controller 73 to accomplish the switching in accordance with a predetermined sequence of colors to be applied.

In addition, the composition and characteristics of the ink and the manner in which the ink is maintained in the machine should be arranged so that the cured ink imparts an easily visible marking to the sheath of the cable. The solids in the ink can be made to remain evenly suspended in the liquid carrier until the ink is applied to the sheath, by continuous mixing.

A variety of inks can be used. The inks could be water-based, acetone-based, or uv-cured. Epoxy coatings, powder coatings, paints, tapes, or films could also be used. An example is a water-based ink comprising a mixture of water, polymers, pigments, 2-butoxyethanol (<0.003), 1-methyl-2-pyrrolidinone (2.5), 2-butanone (<0.5), and N,N-diethylethanamine (<0.5) and available from Performance Coatings Corporation of Levittown, Pa. (The numbers in parentheses represent percentages by weight.)

Other embodiments are within the scope of the following claims.

Although the colors of the markings on the sheath may be identical to the colors on the insulations of the corresponding internal wires, the colors may also differ, for example, by any one or a combination of measures of color, such as hue, saturation, luminance, or intensity. It is useful to choose the combination of sheath colors so that they may be recognized intuitively by a person who is familiar with the color combination of the internal wires that are associated with a particular type of cable. The sheath colors could be different from but indicative of the internal colors. For example, if the internal colors are pink, plum, and brown, the external colors could be red, purple, and black.

As in the example given above, it may not be necessary to include all of the internal colors on the sheath because a subset of the colors may suffice to indicate the type of cable. For example, if the internal colors are red, white, green, brown, and black, it may be sufficient to show red, white, and brown on the sheath. On the other hand, all of the colors of the internal colors may be shown on the sheath. In the case when fewer than all of the colors are shown on the sheath, the ones that are not shown can be ones that identify internal wires in a way that is not unique to the type of cable being marked. For example, cables commonly use internal wire insulation that is gray, green, or white to indicate common conductors or equipment grounds. Those colors might not be included in the colors on the sheath because they do not convey as much information to the observer as the other internal wire insulation colors do.

The patterns in which the internal wire insulation colors are marked on the sheath need not be circumferential stripes of equal length along the sheath. The stripes could be of different lengths for different colors and the boundaries of the stripes could be at different angles to the length of the cable rather than perpendicular as in FIG. 3.

Rather than being circumferential stripes that intersect the longitudinal axis of the cable, the colors could be provided continuously along the length of the cable, for example as continuous longitudinal stripes. The longitudinal stripes could be repeated around the circumference of the cable so that the orientation of the installed cable about its longitudinal axis would not affect an observer's ability to see the combination of colors. Longitudinal stripes would not have to be continuous but could be interrupted periodically along the length of the cable. The longitudinal stripes could be coated on the sheath after the strip has been convoluted. A wide variety of patterns other than stripes could also be used, for example, spots or symbols.

Figure 1:
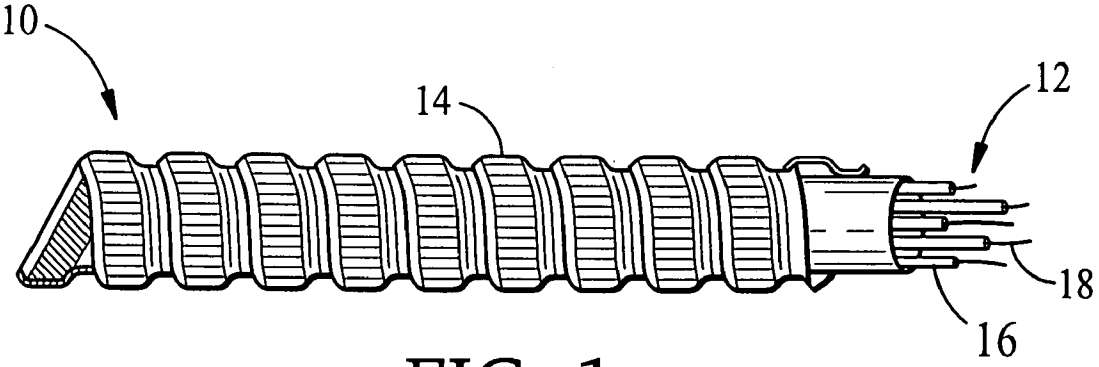
FIG. 1 PRIOR ART
FIG. 1 is a side view of a cable.
Figure 2:
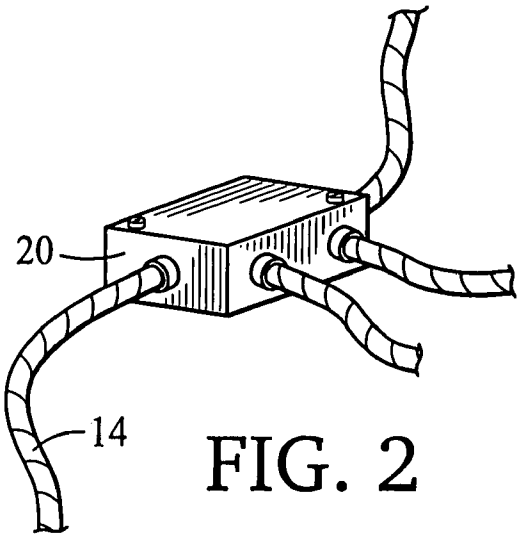
FIG. 2 PRIOR ART
FIG. 2 is a perspective view of a junction box and cables.

The sections of cable that are not marked to indicate the colors of the internal wires could be left plain, for example, the plain steel of a typical helically wound armored cable. Or those sections could be colored in a manner that did not relate directly to the colors on any of the internal wires, as in FIG. 1 where color 46 indicates the type of the cable (MC or AC for example).

The combination of markings need not all be colors nor need any of them be colors. One or more of the markings could be in the form of patterns of a single color, or markings other than colors, for example, embossing or engraving on the sheath. Such patterns may be more durable and easier and cheaper to apply than colors.

Instead of colors, the internal wires could be identified by patterns or other markings and those patterns or markings could be indicated or implied by the sheath markings.

The sheath need not be helically wound, but could be any other kind of metal sheath, such as round or box conduit, solid flexible sheathing that has been formed with helical or other bendable features, or other continuous sheathing.

The sheath need not be metal but could be other materials such as plastic or cloth.

The cable could be designed for purposes other than power distribution.

The cable could be marked in a variety of ways other than coating with ink. For example, the markings could be painted, silk-screened, sprayed, enameled, printed, embossed, anodized, engraved, or cut, or applied using powdered metals. The markings need not be applied to the strip prior to helical winding but could be applied to the sheathing or the material from which the sheathing is made either before the sheathing is formed, before the internal wires are encased in the sheathing, or after they have been encased.

If the strip is coated prior to convolution, the coating need not be done in-line as described above but could be done off-line and then reloaded onto a take-up reel for later use.

When the marking is done by coating ink stripes along the length of a metal strip, the stripes need not be the full width of the strip. The stripe could be narrow and positioned at any place across the width of the strip. It is useful to position the stripe in the middle of the strip so that when the strip is convoluted the coloring appears on the ridges of the sheath rather than on the troughs. It is also useful to make the stripes narrower than the whole width of the strip so that the continuity of the ground formed by the successful convolutions along the length of the finished sheath are not interrupted by the ink at the edges of the strip. Or conductive ink can be used if the stripe is to span the whole width of the strip.

When different types of cable are to bear combinations of markings, the markings on respective cables may bear a relationship to one another to indicate common features of the cables as by using blue to indicate MC cables. Or, by way of another example, various 120-volt power cables could all bear purple stripes in addition to any stripes needed to represent the colors on the internal wires.

Other features of the internal wires can be represented by the markings on the sheath, for example the gauge of the wires, the type of insulation and the type of wires. 12-gauge wire covered with brown insulation, for example, could be indicated by printing a repeated series of brown numbers 12 along the strip instead of a continuous stripe, or by adding an additional colored stripe (e.g., white) around the circumference of the sheath.

In a specific example, a high voltage 12-gauge four-wire MC cable in which two of the wire insulations are brown and orange could be marked by a repeated set of stripes in which one stripe is formed of brown 12*s*, one stripe is formed of orange 12*s*, and one longer stripe is a continuous blue.

What is claimed is:

1. A set of electrical cables comprising:

a first cable having a metal sheath having a common feature indicia and a first non-common feature indicia, and a second cable having a metal sheath having the common feature indicia and a second, non-common feature indicia different from the first non-common feature indicia, the common feature indicia comprising blue to indicate MC cables.

2. The set of electrical cables of claim 1 wherein the common, first non-common, and second non-common feature indicia each denote at least one of a function or type of the cable.

3. The set of electrical cables of claim 2 wherein the common feature indicia and the first non-common feature indicia are different.

4. The set of electrical cables of claim 2 wherein the first non-common feature indicia comprises a stripe.

5. The set of electrical cables of claim 4 wherein the stripe comprises a repeated series.

6. The set of electrical cables of claim 2 wherein the first non-common feature indicia comprises spots.

7. The set of electrical cables of claim 2 wherein the first non-common feature indicia comprises symbols.

8. A set of electrical cables comprising:

a first cable having a metal sheath having a common feature indicia and a first non-common feature indicia, and a second cable having a metal sheath having the common feature indicia and a second, non-common feature indicia different from the first non-common feature indicia, wherein the common feature indicia comprises a stripe indicating a power rating of the cable, and the first and second non-common feature indicia comprise stripes representing colors of conductor insulation.

9. The set of electrical cables of claim 8 wherein the common feature indicia comprises a colored stripe.

10. An electrical cable comprising:

a metal sheath having visible indicia having two features representing at least two features of the cable, wherein one of the features of the cable comprises conductor gauge and one of the features of the cable comprises conductor insulation, and one of the features of the indicia comprises a number indicating the conductor gauge and one of the features of the indicia comprises color indicating color of the conductor insulation.

11. The electrical cable of claim 10 wherein the number includes the color indicating color of the conductor insulation.

* * * * *

UNITED STATES PATENT AND TRADEMARK OFFICE

CERTIFICATE OF CORRECTION

PATENT NO. : 7,465,878 B2
APPLICATION NO. : 10/920278
DATED : December 16, 2008
INVENTOR(S) : Dollins et al.

It is certified that error appears in the above-identified patent and that said Letters Patent is hereby corrected as shown below:

Title Page, item (54), Title:
Please correct the title to read: "Indicia-Coded Electrical Cable"

Title Page, item (56), references Cited, Page 3, Column 2
Line 35, Please correct "Plantiffs'0" to read --Plaintiff's--

Column 1
Line 1, Please correct the title to read: "Indicia-Coded Electrical Cable"

Signed and Sealed this

Twenty-fourth Day of March, 2009

JOHN DOLL
*Acting Director of the United States Patent and Trademark Office*

US007465878C1

(12) EX PARTE REEXAMINATION CERTIFICATE (9824th)

United States Patent
Dollins et al.

(10) Number: US 7,465,878 C1
(45) **Certificate Issued: *Sep. 3, 2013**

(54) INDICIA-CODED ELECTRICAL CABLE

(75) Inventors: James C. Dollins, Bristol, RI (US); Anthony J. Mauro, Assonet, MA (US)

(73) Assignee: Wilmington Trust FSB, Guilford, CT (US)

Reexamination Request:
No. 90/012,085, Jan. 9, 2012

Reexamination Certificate for:

| | |
|---|---|
| Patent No.: | **7,465,878** |
| Issued: | **Dec. 16, 2008** |
| Appl. No.: | **10/920,278** |
| Filed: | **Aug. 18, 2004** |

Certificate of Correction issued Mar. 24, 2009

( * ) Notice: This patent is subject to a terminal disclaimer.

Related U.S. Application Data

(63) Continuation of application No. 09/573,490, filed on May 16, 2000, now Pat. No. 6,825,418.

(51) Int. Cl.
*H01B 7/36* (2006.01)

(52) U.S. Cl.
USPC ..... 174/112

(58) Field of Classification Search
None
See application file for complete search history.

(56) References Cited

To view the complete listing of prior art documents cited during the proceeding for Reexamination Control Number 90/012,085, please refer to the USPTO's public Patent Application Information Retrieval (PAIR) system under the Display References tab.

*Primary Examiner* — Margaret Rubin

(57) ABSTRACT

An electrical cable includes a sheath that envelops at least two internal conductors, and an indicia visible on the sheath is representative of the internal conductor.

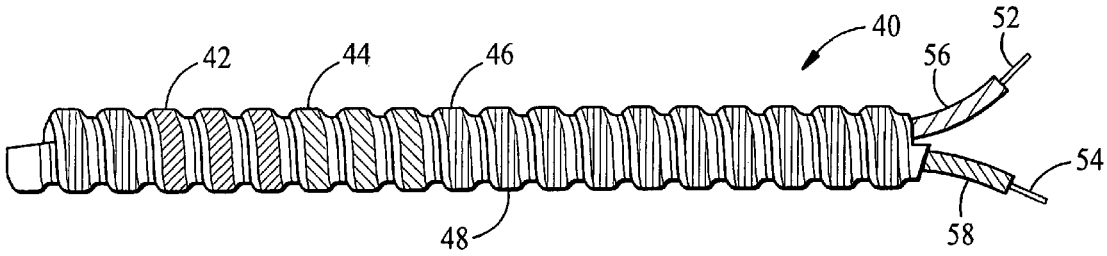

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-11 are cancelled.

* * * * *